United States Patent [19]

Masso Remiro

[11] 4,367,748

[45] Jan. 11, 1983

[54] ANATOMIC-CORRECTING GIRDLE

[76] Inventor: Jose M. Masso Remiro, Sor Eulalia de Anzizu, 11 Barcelona, Spain

[21] Appl. No.: 265,567

[22] Filed: May 20, 1981

[30] Foreign Application Priority Data

Mar. 4, 1981 [ES] Spain ..... 256.654[U]

[51] Int. Cl.[3] ..... A41C 1/04; A41C 1/00

[52] U.S. Cl. ..... 128/521; 128/577

[58] Field of Search ..... 128/521, 577, 552

[56] References Cited

U.S. PATENT DOCUMENTS 3,219,039 11/1965 Ambrose et al. ..... 128/521

3,259,133 7/1966 Clover ..... 128/577

*Primary Examiner*—Doris L. Troutman

*Attorney, Agent, or Firm*—Wenderoth, Lind & Ponack

[57] ABSTRACT

An anatomical-correcting girdle includes two independently made bodies, one of which consists of a composite sheet of fabric plus latex, the fabric being of the ribbed knitted type stretchable in all directions and the ribs being arranged longitudinally with respect to the surface in direct contact with the skin of the user. The other body is made also of a knitted fabric stretchable in all directions, but has a less energetic gripping capacity and forms a cover adapted to the inner body, has an attractive appearance and an adorned surface and is joined to the inner body only at the waist.

1 Claim, 2 Drawing Figures

ANATOMIC-CORRECTING GIRDLE

BACKGROUND AND SUMMARY OF THE INVENTION

The present invention relates to an anatomical correcting girdle of the type made from a composite sheet of fabric-latex which has especially been designed for female use and which differs from known girdles of this type which are considered uncomfortable and unfeminine.

Women, above all young women, have refrained from using garments for correcting malformations, cellulitis, etc., due to two factors, the discomfort of the garment and the outer appearance thereof.

The girdles presently existing in the market are ordinary and poorly functional, being made from poorly ductile materials, reinforcements, ribs, fasteners, etc., which produce an uncomfortable sensation and which are not aesthetic, results incompatible with female undergarments.

Hence a garment was designed whose simplicity and functional character are parallel to the effectiveness thereof, using as the basic fabric a composite sheet of fabric and latex which permits inexpensive manufacture and which does not require special machines.

The composite sheet chosen for the manufacture of the garment was structurally modified to increase the effectiveness thereof, and hence, the inner part or the surface which contacts the skin was ribbed-textured, forming ribs which, together with the latex, should produce a continuous multi-pinching effect on the skin of the user, exerting thereon a permanent massage while the impenetrability of the latex insures, due to exudation, a suitable hydration index on the skin, maintaining it moist and flexible.

On the other hand, the form of the garment thus manufactured was modified, departing from a pattern in which tubular parts intervene and, what is more important, arranging the ribs longitudinally with respect to the axis of symmetry of the body and, therefore, in line with the circulation of the blood, enhancing the peripheric irrigation.

The girdle thus made was functionally suitable for the purpose for which it was designed. Nevertheless, an important factor remained to be solved, i.e. the ornamental aspect.

In fact the visible surface of the garment lacked embroideries, trimmings, etc., which would give it an appearance identical to that of conventional undergarments. However, this was not possible since the nature of the outersurface of the garment, including latex, was not suitable inasmuch as it was not of a fine fabric such as, for example, silk.

On the other hand, embroidery and adornments could not easily be sewn by unskilled means on the layered sheet of which the garment was formed.

Due to the aforegoing, the garment was enclosed with an ornamental element, the only purpose of which is to cover the inner garment.

The cover is comprised of a fine fabric, for example, a stretchable knitted silk material incorporating all the necessary adornments and having a sufficient gripping capacity to be adapted to the girdle, covering the same without influencing the function thereof.

Both bodies, the inner and the outer, are complementary and are joined together at a single zone which is invariable, i.e. the waist. In this way comfort during use is guaranteed without losing any of the functional and ornamental characteristics thereof.

BRIEF DESCRIPTION OF THE DRAWINGS

These and other characteristics of the invention are represented in the accompanying drawings, wherein.

DETAILED DESCRIPTION OF THE INVENTION

Figure 1:
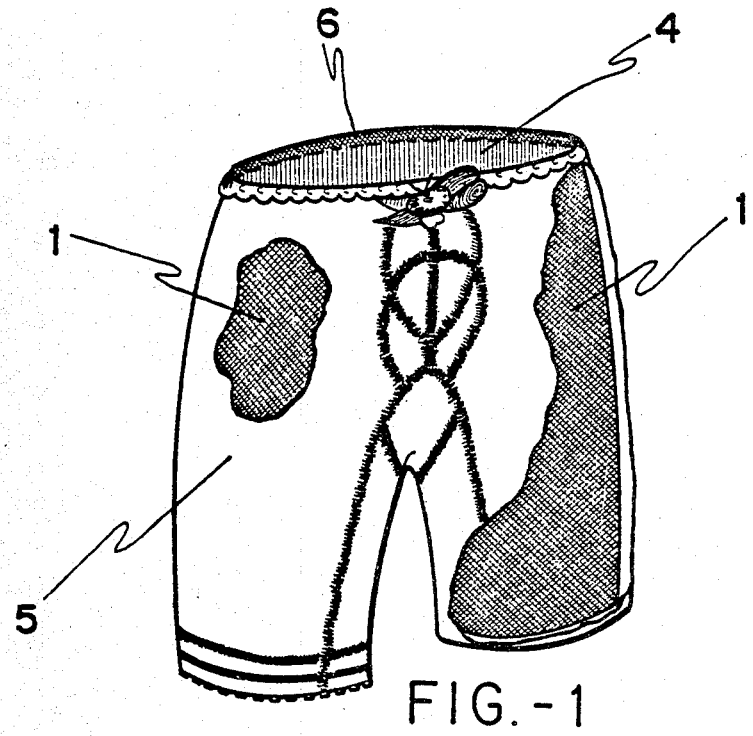
FIG. 1 is a perspective view of the girdle of the invention, with portions broken away to represent hidden details.
Figure 2:
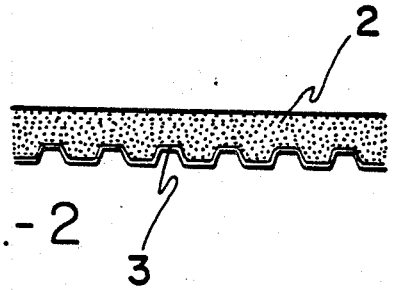
FIG. 2 is a partial section, on an enlarged scale, of a detail of the constitution of the composite sheet forming the inner body of the girdle.

Referring to the drawings, there is shown a girdle according to the invention and including an inner body 1 made of a composite sheet of fabric and latex and an outer body 5 joined to inner body 1 at the waist area, as at zone 6. FIG. 2 shows inner body 1 as including an outer layer 2 of latex joined to an inner layer 3 of ribbed fabric sheet. The ribs 4 contact the skin of the wearer and are longitudinally arranged. Outer body 5 constitutes a cover and is joined at zone 6 to inner body 1.

It is clear that the cover 5 must be joined to the inner body 1 at at least one point so that both parts are superimposed with exactitude and ease. However, it is not recommendable for both of them to be joined at additional points in order to prevent creases and to facilitate washing and drying.

I claim:

1. An anatomical correcting girdle comprising:

a composite inner body including an inner layer of ribbed knitted fabric joined to an outer layer of latex, said knitted fabric being stretchable in all directions and having ribs oriented longitudinally;

an outer body of knitted fabric stretchable in all directions and having a less energetic gripping capacity than said inner body, said outer body having an adorned surface and aesthetic appearance; and said outer body comprising a cover over said inner body and being joined thereto only at the waist.

* * * * *